US008281767B2

(12) United States Patent
Kuhnke et al.

(10) Patent No.: US 8,281,767 B2
(45) Date of Patent: Oct. 9, 2012

(54) PRESSURE BOOSTER WITH INTEGRATED PRESSURE RESERVOIR

(75) Inventors: Dominik Kuhnke, Gerlingen (DE); Dirk Vahle, Vaihingen A.D. Enz/Ot Pulverdin (DE)

(73) Assignee: Robert Bosch GmbH, Stuttgart (DE)

( * ) Notice: Subject to any disclaimer, the term of this patent is extended or adjusted under 35 U.S.C. 154(b) by 276 days.

(21) Appl. No.: 12/600,374

(22) PCT Filed: May 5, 2008

(86) PCT No.: PCT/EP2008/055456

§ 371 (c)(1),
(2), (4) Date: Nov. 16, 2009

(87) PCT Pub. No.: WO2008/138790

PCT Pub. Date: Nov. 20, 2008

(65) Prior Publication Data

US 2010/0154744 A1 Jun. 24, 2010

(30) Foreign Application Priority Data

May 15, 2007 (DE) ..... 10 2007 022 857

(51) Int. Cl.
*F02M 57/02* (2006.01)
*F02M 37/04* (2006.01)

(52) U.S. Cl. ..... 123/446; 123/447; 123/511; 417/401

(58) Field of Classification Search ..... 123/446, 123/447, 457, 458, 510, 511; 417/392–401
See application file for complete search history.

(56) References Cited

U.S. PATENT DOCUMENTS

| | | | | |
|---|---|---|---|---|
| 3,809,502 | A * | 5/1974 | Henry | 417/225 |
| 4,271,671 | A * | 6/1981 | Smeets | 60/578 |
| 4,512,151 | A * | 4/1985 | Yamatani | 60/581 |
| 5,170,691 | A * | 12/1992 | Baatrup | 91/287 |
| 5,337,561 | A * | 8/1994 | Raghavan et al. | 60/421 |
| 5,429,036 | A * | 7/1995 | Latos | 91/181 |
| 5,642,714 | A | 7/1997 | Buckley | |
| 6,619,263 | B1 | 9/2003 | Otterbach et al. | |
| 6,786,205 | B2 * | 9/2004 | Stuhldreher et al. | 123/495 |
| 7,451,742 | B2 * | 11/2008 | Gibson et al. | 123/446 |
| 7,543,568 | B1 * | 6/2009 | Prior | 123/456 |

FOREIGN PATENT DOCUMENTS

| | | | |
|---|---|---|---|
| DE | 19939422 | A1 | 3/2001 |
| EP | 0711914 | A1 | 5/1996 |
| EP | 1125046 | B1 | 11/2004 |

* cited by examiner

*Primary Examiner* — Thomas Moulis
(74) *Attorney, Agent, or Firm* — Michael Best & Friedrich LLP

(57) ABSTRACT

The invention relates to a high-pressure injection system, in particular for auto-igniting internal combustion engines, with at least one high pressure pump and a high pressure reservoir, through which at least one fuel injector is supplied with a fuel under pressure. The high-pressure injection system comprises at least one pressure booster unit which has at least two pressure boosters, each with a high pressure piston which can be driven independently of the other.

16 Claims, 6 Drawing Sheets

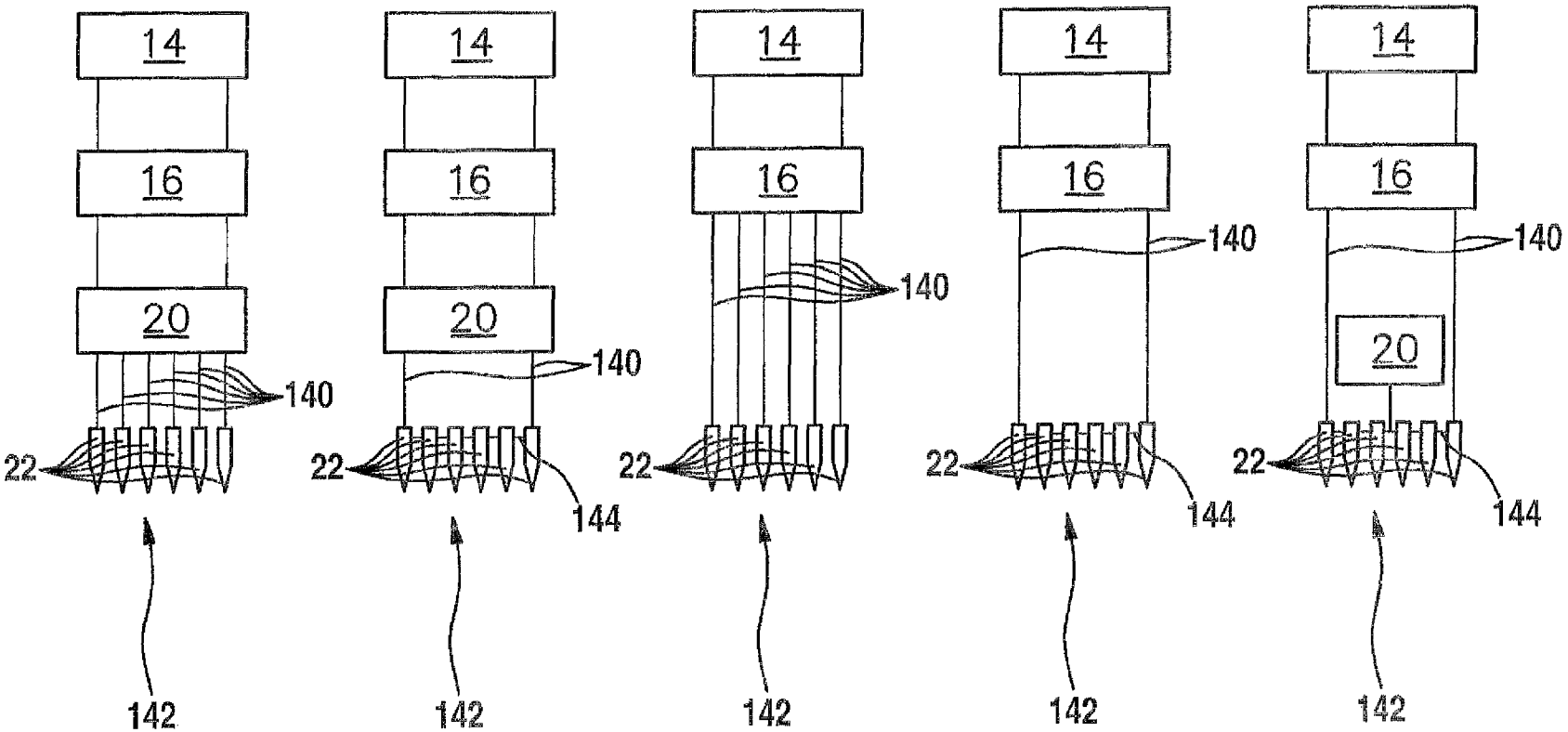
Fig. 9.1
Fig. 9.2
Fig. 9.3
Fig. 9.4
Fig. 9.5

PRESSURE BOOSTER WITH INTEGRATED PRESSURE RESERVOIR

CROSS-REFERENCE TO RELATED APPLICATION

This application is a 35 USC 371 application of PCT/EP2008/055456 filed on May 5, 2008.

BACKGROUND OF THE INVENTION

1. Field of the Invention

The invention relates to a high-pressure injection system, in particular for auto-igniting internal combustion engines.

2. Description of the Prior Art

European Patent Disclosure EP 0 711 914 A1 relates to a pressure-controlled fuel injection system, in which, with the aid of a high-pressure pump, fuel is compressed to a first high fuel pressure of approximately 1200 bar and stored in a first pressure reservoir. The fuel under high pressure is also supplied to a second pressure reservoir, in which, by regulation of its fuel delivery by means of a 2/2-way valve, a second high fuel pressure of approximately 400 bar is maintained. Via a valve control unit, either the lower or the higher fuel pressure is conducted into the nozzle chamber of an injector. There, a spring-loaded valve body is lifted from its valve seat by the pressure, so that fuel can emerge from the nozzle opening into the combustion chamber.

A disadvantage of this known fuel injection system is the fact that all the fuel must first be compressed to the higher pressure level and then some of the fuel is relieved again to the lower pressure level. Moreover, the high-pressure pump, since it is driven by the camshaft of the engine, is constantly in operation, even when the desired pressure in the respective pressure reservoir has already been built up. This permanent generation of high pressure and the ensuing relief to the low-pressure level stand in the way of improved efficiency.

The high-pressure fuel pumps used in the field of self-igniting internal combustion engines are currently capable of building up pressures of up to approximately 2200 bar. Pressures beyond that are possible either with two-stage high-pressure pumps or with additional pressure boosters outside or inside the fuel injectors. Two-stage high-pressure pumps require markedly greater installation space and are not compatible with current systems. Moreover, the mechanical load in terms of pump development is considered critical. Internal and external pressure boosters are currently used solely as local pressure boosters for individual injectors; that is, per injector, one pressure booster is in use. In terms of expense, this first means a large number of additional components, and in terms of function, it means poor efficiency in pressure-boosted injection of small quantities, since for each pressure boosting event, there must be a minimum turnover in the control quantity in the pressure booster. One such central pressure booster is known for instance from European Patent Disclosure EP 1 125 046 B1.

SUMMARY OF THE INVENTION

According to the invention, a pressure booster is proposed that is an individual, separate structural unit and is approximately the same size as, and takes on the function of, the pressure reservoir that is conventionally used. In the conventional pressure reservoir, a conventional high-pressure pump represents a currently common pressure level on the order of magnitude of approximately 2000 bar, which will hereinafter be called medium pressure. The pressure booster proposed according to the invention advantageously has at least two pistons for attaining the pressure boosting, which are operated in alternation and thus enable a continuous supply at high pressure, that is, at a pressure level of >2500 bar. The supplied quantity can therefore be made available to the individual fuel injectors even without a large high-pressure reservoir, since a pressure drop from withdrawal at the injector can be maximally compensated for by immediate replenishment.

Thus the complex separate pressure boosting for each individual fuel injector provided in a fuel injection system is eliminated, so that functionally, the significant advantage is attained that, at injection pressures below the maximum pressure of the high-pressure pump, the required quantity can be supplied to the individual fuel injectors without activation of the pressure booster. Precisely for lesser injection quantities to be introduced into the combustion chambers of self-igniting internal combustion engines, this means a pronounced increase in the hydraulic efficiency, because of the elimination of the previously necessary pressure booster control quantity.

Alternatively, a simplified version of the pressure booster with only one on-off valve and one pressure booster piston each is equally conceivable, for the case where the restoration time of the pressure booster piston is sufficiently short for the required engine rpm and thus for the activation frequency of the pressure booster. In that case, a different boosting ratio of the pressure booster may be necessary.

BRIEF DESCRIPTION OF THE DRAWINGS

The invention will be described in further detail below in conjunction with the drawings, in which:

Shown are:

FIGS. 9.1 through 9.5 shows system images for the high-pressure injection system, proposed according to the invention, with variant forms of piping.

DESCRIPTION OF THE PREFERRED EMBODIMENTS

Figure 1:
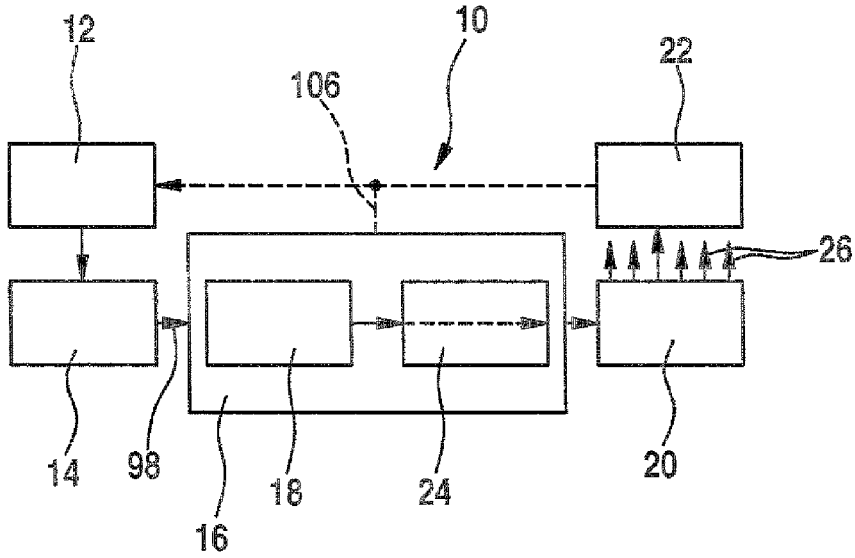
FIG. 1 shows a first embodiment of the high-pressure injection system, proposed according to the invention, with a pressure booster unit.

A first embodiment of the high-pressure injection system can be seen in FIG. 1. The high-pressure injection system as shown in FIG. 1 includes, besides a tank 12, a high-pressure pump 14. The high-pressure pump acts upon a pressure booster unit 16, which in this first embodiment includes both an intermediate rail 18 and an optionally activatable pressure booster 24. The pressure booster unit 16 in turn acts upon an externally disposed high-pressure reservoir 20, which in turn has a number of high-pressure connections 26. Via the high-pressure connections 26, which are provided on the high-pressure reservoir 20 in a number that corresponds to the number of fuel injectors 22 to be supplied with fuel, the internal combustion engine, not shown in FIG. 1, is supplied. Via the dashed lines from the fuel injector 22 or from the pressure booster unit 16, a control or leakage quantity is returned to the tank 12 of the high-pressure injection system 10.

Figure 2:
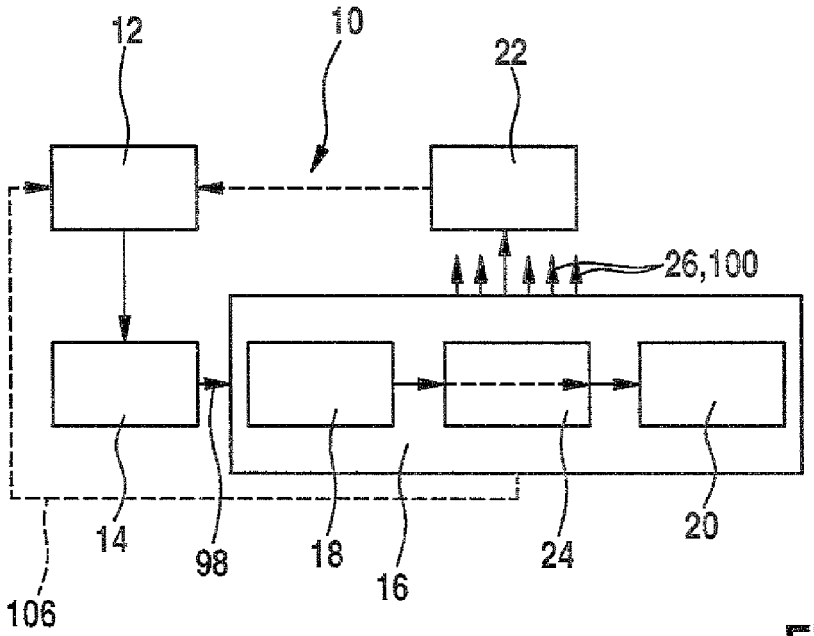
FIG. 2 shows a second embodiment of the high-pressure injection system, proposed according to the invention, having a pressure booster unit with which an intermediate pressure reservoir and a high-pressure reservoir are integrated.

FIG. 2 shows a second embodiment of the high-pressure injection system proposed according to the invention, in which in a distinction from what is shown in FIG. 1, the pressure booster unit 16 includes the intermediate rail 18, the optionally activatable pressure booster 24, and the high-pressure reservoir 20 as an integrated component. In that case, the high-pressure connections 26, corresponding in number to the number of fuel injectors 22 to be supplied with fuel, are provided on the pressure booster unit 16. As can be seen from FIG. 2, a leakage or control quantity, both from the pressure booster unit 16 and from the at least one fuel injector 22, is returned to the tank 12 of the high-pressure injection system 10 via the lines represented by dashed lines.

Figure 3:
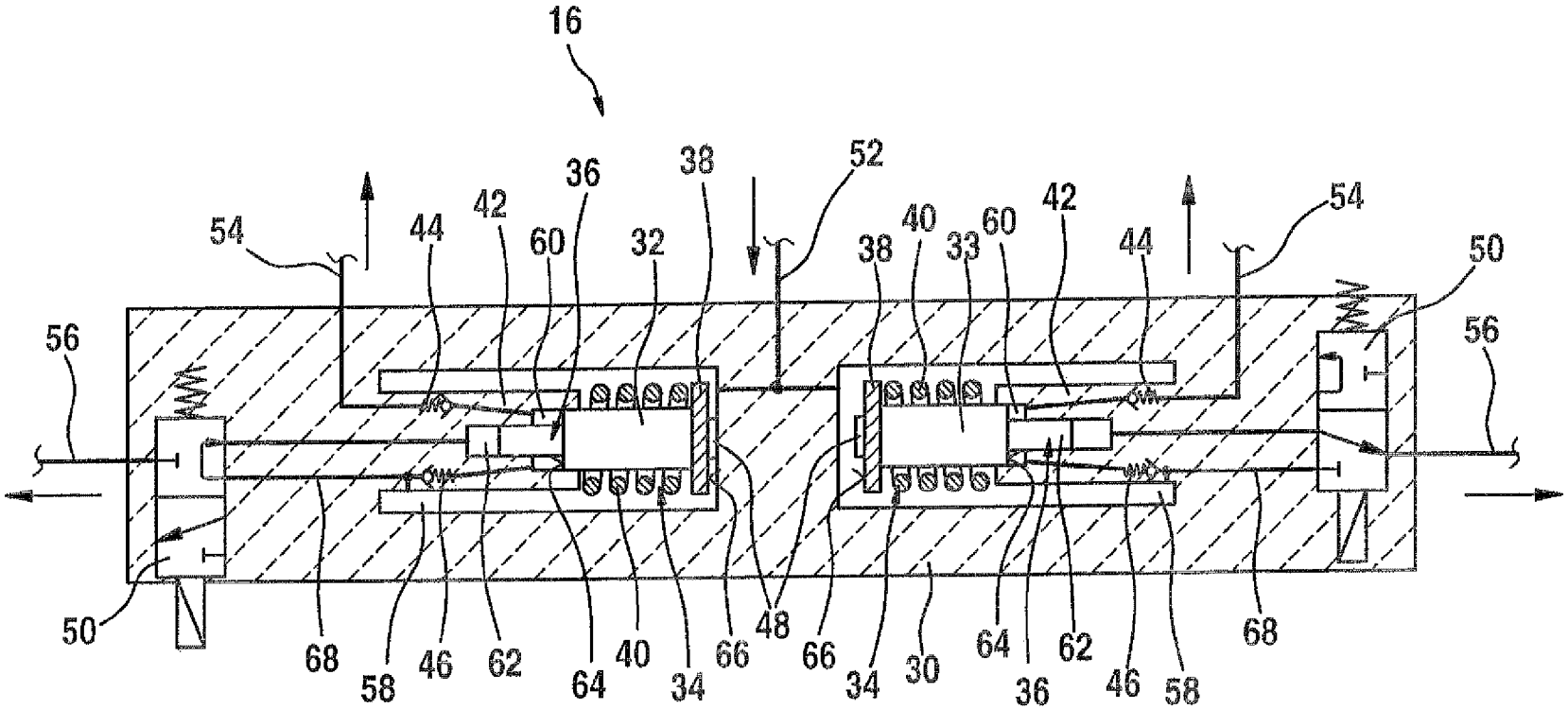
FIG. 3 is a sketch of the pressure booster unit with two pressure boosters.

FIG. 3 shows the schematic makeup of the pressure booster; two such boosters are installed in each of the pressure booster units shown in FIGS. 1 and 2.

As can be seen from FIG. 3, a pressure booster 24, of which at least one is installed in a pressure booster unit 16, includes a base body 30. In the base body 30, there are pressure booster pistons 32, 33. The pressure booster units 16 shown in FIGS. 1 and 2 each include two pressure boosters 24.

The pressure booster piston 32 is disposed in the base body 30 and has both a first piston part 34 of larger diameter and a second piston part 36 of lesser diameter. An annularly embodied collar 38, on which a restoring spring 40 is braced, is located on the first pressure piston part 34. The restoring spring 40 is also braced on an annular face of a piston guide body 42.

Both a high-pressure valve 44 and a filling valve 46 are located in the base body 30 of the pressure booster 24 shown in FIG. 3. These two valves 44, 46 are preferably embodied as check valves. The high-pressure valve 44 is located in a reservoir supply line 54 that communicates with a high-pressure chamber 60. The high-pressure chamber 60 is defined on one side by the piston guide body 42 and on the other side by a high-pressure face 64.

The filling valve 46 is located in a hydraulic line which as shown in FIG. 3 connects a control chamber 62, via an on-off valve 50 and a bypass 68, to a reservoir volume 58. The on-off valve 50, which may for instance be embodied as a 3/2-way valve, for instance as an on-off valve actuated by a magnet valve, is also integrated with the base body 30 of the pressure booster 24 shown in FIG. 3.

Extending from the base body 30 of the pressure booster 24 as shown in FIG. 3 are a pressure booster return 56, located downstream of the on-off valve 50; the reservoir supply line 54 with the integrated high-pressure valve 44, which extends to the high-pressure reservoir 20 in the system overviews in FIGS. 1 and 2; and a pressure booster inlet 52, which is acted upon by way of the high-pressure pump 14 shown in FIGS. 1 and 2. It can also be seen from FIG. 3 that the reservoir volume 58, which is also called a medium-pressure reservoir, communicates with the control chamber 62 via a bypass 68.

At injection pressures below the maximum supply pressure of the high-pressure pump 14, what is here called a medium pressure is supplied by the high-pressure pump 14, via the pressure booster inlet 52, into the reservoir volume 58, which is embodied in one or more parts, and onward via the filling valve 46 and the high-pressure valve 44 directly to the reservoir supply line 54. From there, it reaches either an external high-pressure reservoir 20, shown in FIG. 1, or, —via the internal high-pressure reservoir—the fuel injectors 22, as shown in FIG. 2.

In this case, the pressure booster 24 as schematically shown in FIG. 3 is operated in the bypass mode, in which no pressure boosting is necessary, and therefore no significant losses of efficiency occur. In the bypass mode, supply is done simultaneously through all the available pressure boosters 24 of a pressure booster unit 16—as shown in FIGS. 1 and 2.

If pressure boosting is necessary, the pressure boosters 24 of the pressure booster unit 16 can be used in alternation or simultaneously. In each of these cases, the corresponding on-off valve 50, which is preferably a 3/2-way valve, is switched. The control chamber 62 of the pressure booster piston 32 communicates with the pressure booster return 56 as a consequence of the activation of the on-off valve 50 and is accordingly pressure-relieved. As a result, the pressure in the high-pressure chamber 60 of the pressure booster 24 increases, until a force equilibrium has been established between the high pressure at the high-pressure face 64 of the high-pressure piston 32 and the force generated by the restoring spring 40, on the one hand, and the medium pressure at the medium-pressure face 66 of the pressure booster pistons 32, 33, on the other.

Preferably, the boosting ratio i, defined by the two pressure faces 64 and 66, is equivalent to the quotient of the desired maximum pressure, which is supplied to the reservoir supply line 54, and the supply pressure of the high-pressure pump. Thus the high-pressure quantity is replenished by the high-pressure valve 44 when the pressure at the high-pressure connection, that is, in the reservoir supply line 54, drops as the result of a withdrawal of quantity. Via the filling valve 46, the communication with the reservoir volume 58 is closed.

Upon deactivation of the on-off valve 50, the control chamber 62 of the high-pressure piston 32 is made to communicate with the reservoir volume 58, and as a result the pressure in the control chamber 62 rises, and in a hydraulic force equilibrium, the pressure booster piston 32, 33 is positioned at its stop limitation 48 by the spring force of the restoring spring 40.

Preferably, the activation of the on-off valves 50, each associated with one pressure booster 24, is synchronized with the injections, so that one supply stroke of the pressure booster 24 ensues per cylinder of the engine to be supplied with fuel and per 720° of crankshaft angle, in the case of a 4-cycle internal combustion engine. It is correspondingly assured that the restoring time of each pressure booster piston 32 and 33, respectively, of the at least one pressure booster 24 is sufficiently short that, in the case of a pressure booster unit 16 equipped with two pressure boosters 24, supply can be done at every other injection.

The pressure booster unit 16 as shown in FIGS. 1 and 2, besides the intermediate reservoir (intermediate rail), preferably includes two pressure boosters 24 and optionally—as shown in the embodiment of FIG. 2—a high-pressure reservoir 20 (high-pressure rail), which is integrated with the pressure booster unit 16.

Figure 4:
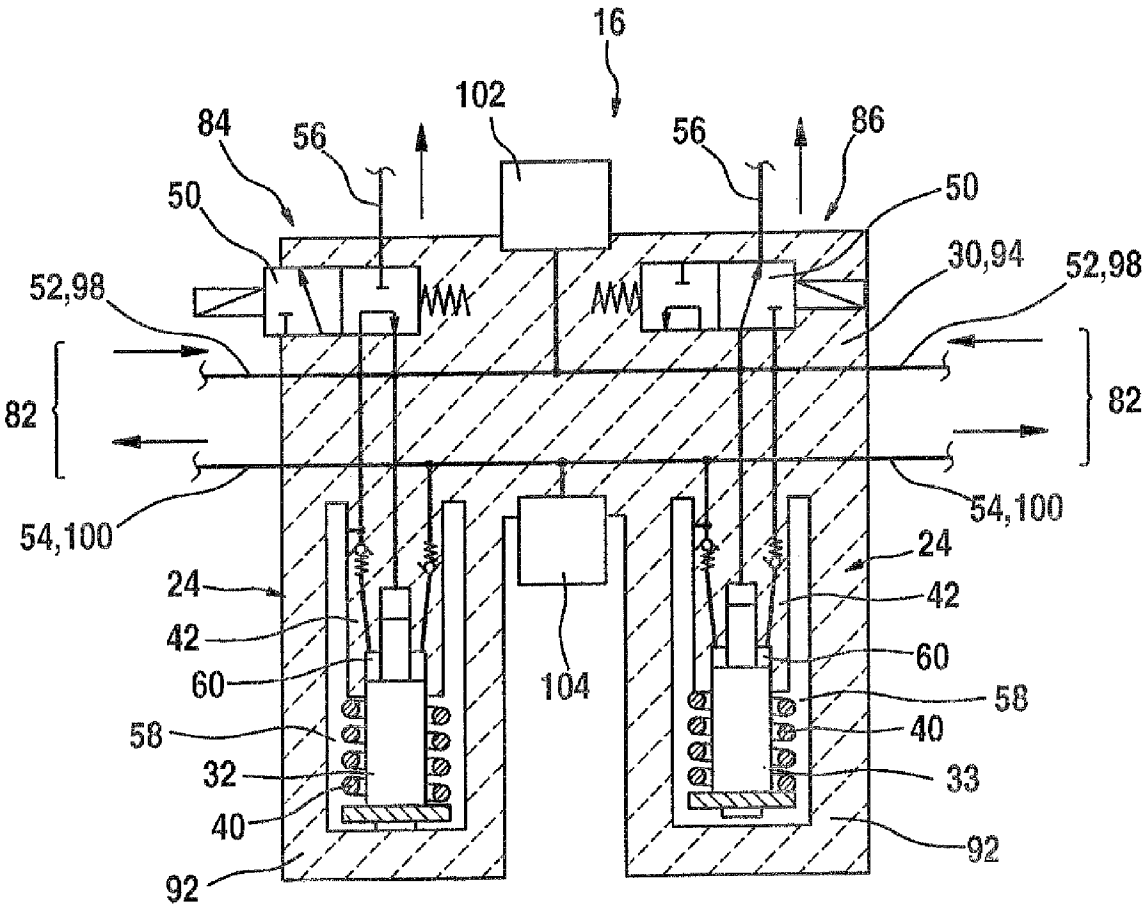
FIG. 4 shows a further embodiment of the pressure booster unit proposed according to the invention (without a high-pressure reservoir)
Figure 5:
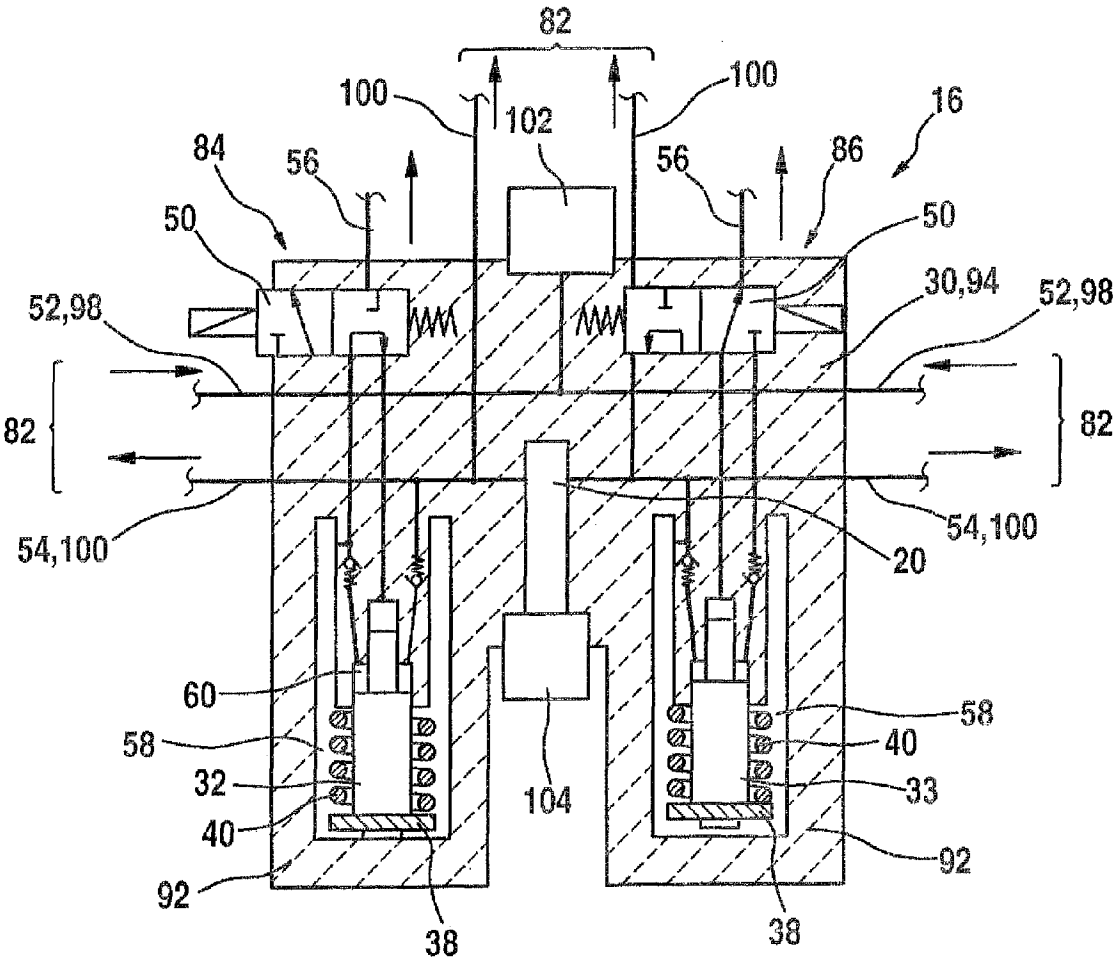
FIG. 5 shows a pressure booster unit (with an integrated high-pressure reservoir)

In FIGS. 4 and 5, various embodiments of pressure booster units, which are shown only schematically in FIGS. 1 and 2, are represented. The intermediate reservoir 18 (intermediate rail) is not necessarily a separate component, but instead is divided into a reservoir volume 58 (see FIG. 3) of the preferably two pressure boosters 24 constricted inside one pressure booster unit 16.

As seen for instance from FIG. 4, the pressure booster unit 16 can include a U-shaped central body 94, which has reservoir pots 92 in which the individual pressure boosters 24 of the pressure booster unit 16 are made. On each face end of the central body 94 are a first on-off unit 84 and a second on-off unit 86, respectively, each embodied as a 3/2-way valve for an on-off valve 50. Laterally on the U-shaped central body 94 of the pressure booster unit 16, there are connections 82, which are the connections 82 shown in FIG. 3, namely the pressure booster inlet 52, the reservoir supply line 54, and the pressure booster return 56. For instance, the high-pressure pump 14 shown in FIG. 1 is connected to the pressure booster inlet 52—see also reference numeral 98; see reference numeral 98 in FIG. 1. The connections 82 at the U-shaped central body 94 of the pressure booster unit 16 also, as shown in FIG. 4, include high-pressure connections 100, which lead for instance to the high-pressure reservoir 20 shown in FIG. 1.

It can also be seen from FIG. 4 that the two pressure boosters 24, of which one pressure booster 24 has the pressure booster piston 32 and the other pressure booster 24 has the pressure booster piston 33, are disposed parallel to one another. The pressure booster 24 having the pressure booster piston 32 is inactive; the other pressure booster 24 having the pressure booster piston 33 is active. Both a pressure regulating valve 102 and a pressure sensor 104 are located on the central body 94 of the pressure booster unit 16. It can also be seen from FIG. 4 that the active one of the two pressure boosters 24 carries fuel, compressed in accordance with the pressure boosting ratio i, to the high-pressure reservoir 20 shown in FIG. 1 via the respective reservoir supply lines 54. The construction of the pressure boosters 24 shown in the embodiment of FIG. 4 is essentially equivalent to what is shown for the pressure boosters 24 in FIG. 3.

The pressure booster unit 16 in the embodiment shown in FIG. 5 likewise has connections 82, which represent the pressure booster inlet 52 and the reservoir supply line 54. The pressure booster return is not shown.

In FIGS. 4 and 5, pressure booster units 16 are shown in each case that have a reduced structural length, which is achieved because of the U-shaped, one-piece central body 94. Also in the embodiments of FIGS. 4 and 5, connection possibilities are provided on the face end of the one-piece central body for the pressure sensor 104 and the pressure regulating valve 102 which is shown schematically there.

While FIG. 4 represents a variant of the first embodiment of FIG. 1, FIG. 5 represents a variant of the second embodiment of FIG. 2, with an integrated high-pressure reservoir 20.

It can be seen from FIG. 5 for example that the pressure booster unit 16 has a very compact structure, which is attained by means of the one-piece central body 94. In this embodiment of the pressure booster unit 16 as well, in accordance with what is schematically shown in FIG. 1, two pressure reservoir pots 92 are provided, which are placed next to one another. Diametrically opposite the two pressure reservoir pots 92 on the one-piece central body 94 are the first on-off unit 84 and the second on-off unit 86, which can be embodied for instance as magnet valves; see reference numeral 50 in FIG. 3.

In FIG. 5, an embodiment of the pressure booster unit 16 with an integrated high-pressure reservoir of FIG. 4 can be seen.

Also from FIG. 5, a pressure booster unit 16 with a central body 94, here embodied in one piece analogously to FIG. 4, can also be seen. In this embodiment, the two pressure reservoir pots 92 and the first on-off unit 84 and the second on-off unit 86 are all disposed side by side on the one-piece central body 94. In the view in FIG. 5, reference numeral 98 indicates a pump connection analogous to reference numeral 52 in the embodiment of FIG. 3 that designates the pressure booster unit inlet. Reference numeral 100, conversely, identifies a high-pressure connection, analogous to reference numeral 54 in the embodiment of FIG. 3; the fuel injectors or the high-pressure lines that lead to them are connected there.

The pressure booster unit 16 in the embodiment shown in FIG. 5 is a pressure booster unit with which a 4-cylinder internal combustion engine, for instance, with fuel at system pressure can be supplied. The connections 82 are located laterally on the one-piece central body 94. Together with the high-pressure connections 82 and 100 disposed laterally on the central body 94, it is possible for instance for four fuel injectors, or four high-pressure lines that lead to four fuel injectors, to be connected to the pressure booster unit 16 shown in FIG. 5.

Figure 6:
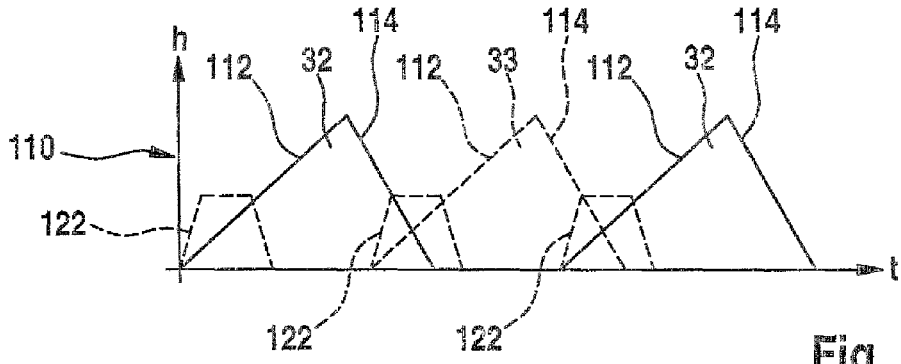
FIG. 6 shows the alternative mode of operation of the pressure booster pistons with synchronous injection.

FIG. 6 shows an alternating mode of operation of two pressure booster pistons with synchronous injection.

From FIG. 6, it can be seen that a piston stroke h of a first pressure booster piston 32 and of a second pressure booster piston 33—the latter indicated by dashed lines—is plotted over time t. Reference numeral 122 represents the activation of each fuel injector 22, and the fuel injectors 22 each have an injection characteristic that for instance extends in ramplike fashion, while the fuel is introduced into the various cylinders of the engine. Instead of a ramplike injection characteristic, multiple injections can also be made, or arbitrary further injection strategies be implemented. As can be seen from FIG. 6, stroke courses 112 and 114 in an alternating mode of operation 110 of the respective pressure booster pistons 32, 33 can overlap one another slightly. While the first stroke course 112 and the second stroke course 114 of the first pressure booster piston 32 is represented by solid lines, the first stroke course 112 and the second stroke course 114 of the second pressure booster piston 33 is by comparison represented by dashed lines. The prerequisite for the alternating mode of operation, as indicated by reference numeral 110, of the pressure booster unit 16 is that the pressure booster unit 16 shown schematically in FIGS. 1 and 2 includes two pressure boosters 24 as shown in FIG. 3.

Figure 7:
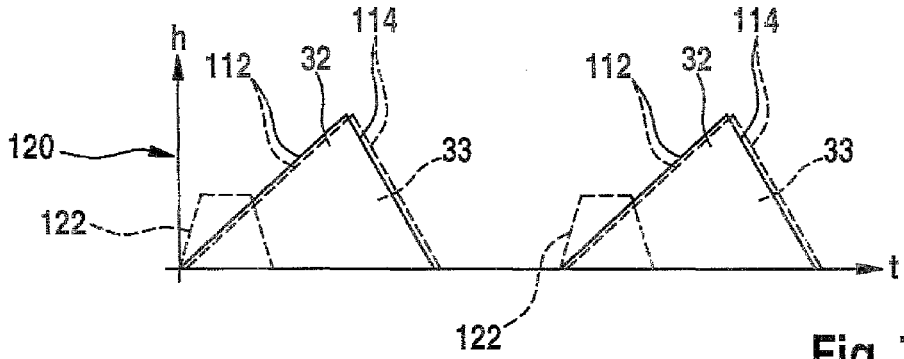
FIG. 7 shows synchronous injections in the synchronous mode of operation of the pressure booster pistons.
Figure 8:
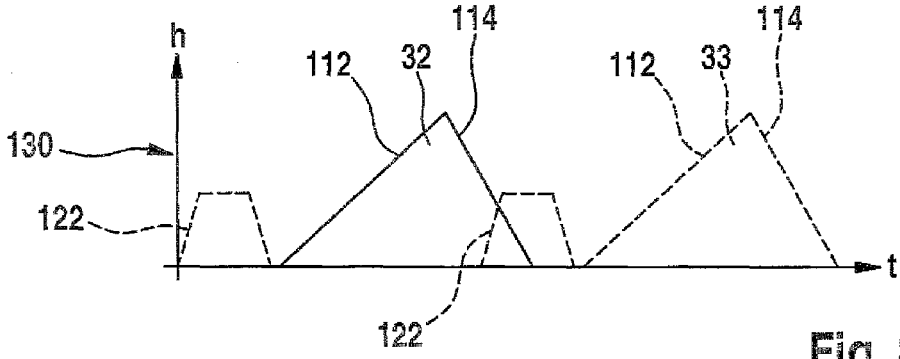
FIG. 8 shows the alternating mode of operation of pressure booster pistons with asynchronous injection.

From FIG. 7, a synchronous mode of operation of a pressure booster unit 16 with two pressure boosters 24 can be seen. From the stroke courses of the first stroke 112 and the second stroke 114 shown in FIG. 7, it can be seen that in this case, the first high-pressure piston 32 and the second high-pressure piston 33—the latter indicated by dashed lines—are both operated synchronously. In this case, the respective first stroke courses 112 and second stroke courses 114 each coincide. Because of the overlapping supply strokes 112 and 114 of the two pressure booster pistons 32 and 33, respectively, the supply quantity can be increased, and the pressure drop in the high-pressure reservoir 20 of the high-pressure injection system 10 in the schematic overview drawings in FIGS. 1 and 2 can be further reduced. The individual injection events are preferably effected synchronously with the supply—as indicated in FIG. 7—in order thereby to keep the pressure drop slight. As is shown in conjunction with FIG. 8, which shows an alternating mode of operation of the pressure booster pistons with asynchronous injection, the injections can also if necessary be made between the individual pressure booster strokes 112 and 114 of the first pressure booster piston 32 and the second pressure booster piston 33, respectively. To that end, replenishment may be provided in the intervals between the individual injection events. In a distinction from what is shown in FIG. 7, the first pressure booster piston 32 and the second pressure booster piston 33 execute a first stroke 112 in the intervals between injections of fuel injectors 22, which here are shown emphasized as examples. A further stroke 114 may coincide in part, entirely, or not at all with an injection. In this connection, it is definitive that the first stroke 112 does not coincide with the injection but instead takes place in an interval between injections.

As can be seen from the sequence of FIGS. 9.1 through 9.5, the pressure booster unit 16 as schematically shown in FIGS. 1 and 2 can be made to communicate hydraulically with the fuel injectors in various ways.

FIG. 9.1 shows that the high-pressure pump 14 subjects the pressure booster unit 16 to fuel at high pressure, at a pressure level of approximately 2000 bar. The pressure booster unit 16 in turn subjects the externally disposed high-pressure reservoir 20 to a pressure which is elevated in accordance with the boosting ratio i of the two pressure boosters 24; FIG. 9.1 involves an externally disposed high-pressure reservoir 20. From this high-pressure reservoir, individual high-pressure lines 140 lead to the various fuel injectors 22. In this variant form of piping in FIG. 9.1, they supply a 6-cylinder internal combustion engine.

From FIG. 9.2, a variant form of piping can be seen that is slightly modified compared to the variant in FIG. 9.1. In the embodiment of FIG. 9.2, the high-pressure pump 14 acts on the pressure booster unit 16, which acts in turn on the external high-pressure reservoir 20. In FIG. 9.2, a ring line 142 represented by individual connecting pieces 144 extends between the various fuel injectors 22. As a result, individual high-pressure lines 140—as used in FIG. 9.1—associated with each of the individual fuel injectors 22 can be avoided. The ring line 142 for connecting the fuel injectors 22 has a major advantage from a hydraulic standpoint, since the reservoir volume in the fuel injectors 22, with only slight three-dimensional spacings, reduces pressure drops and resultant pressure fluctuations. If the rail, that is, the high-pressure reservoir 20, disposed externally relative to the pressure booster unit 16 in FIGS. 9.1 and 9.2 is dispensed with, then via the ring line 142, the number of necessary connections to the pressure booster unit 16 can furthermore be reduced in comparison to the variant embodiment of FIG. 9.3; see for instance the embodiments in FIGS. 9.4 and 9.5.

In the embodiment of the piping layout shown in FIG. 9.3, at the pressure booster unit 16 shown schematically there, six individual high-pressure lines 140 are connected to the individual fuel injectors 22, while in the pressure booster units 16 in the embodiments of FIGS. 9.4 and 9.5, compared with the embodiment of FIG. 9.3, 9.5, only two individual high-pressure lines 140 have to be connected, since the fuel injectors 22 in turn communicate with one another via connecting pieces 144 inside the ring line 142. In the variant form of piping shown in FIG. 9.5, the high-pressure reservoir 20 is disposed externally relative to the pressure booster unit 16 and acts directly on a connecting piece 144 of the ring line 142 between the fuel injectors 22.

The foregoing relates to the preferred exemplary embodiments of the invention, it being understood that other variants and embodiments thereof are possible within the spirit and scope of the invention, the latter being defined by the appended claims.

The invention claimed is:

1. A high-pressure injection system, in particular for self-igniting internal combustion engines, comprising:

at least one high-pressure pump;

a high-pressure reservoir;

at least one fuel injector supplied with fuel under pressure from the high-pressure reservoir;

at least one pressure booster unit that has at least two pressure boosters, each pressure booster having one high-pressure piston which can be operated independently of one another, and wherein the pressure booster unit includes an intermediate reservoir as an integrated component.

2. The high-pressure injection system as defined by claim 1, wherein the pressure booster unit includes a high-pressure reservoir.

3. The high-pressure injection system as defined by claim 1, wherein the pressure booster unit is embodied in elongated form and at least one on-off unit is received on a face end of the pressure booster unit.

4. The high-pressure injection system as defined by claim 2, wherein the pressure booster unit is embodied in elongated form and at least one on-off unit is received on a face end of the pressure booster unit.

5. The high-pressure injection system as defined by claim 1, wherein the pressure booster unit has lateral attachment positions for at least one on-off unit, and one pressure reservoir head is provided on each face end of the pressure booster unit.

6. The high-pressure injection system as defined by claim 2, wherein the pressure booster unit has lateral attachment positions for at least one on-off unit, and one pressure reservoir head is provided on each face end of the pressure booster unit.

7. The high-pressure injection system as defined by claim 1, wherein the pressure booster unit includes a one-piece central body, on which connections are provided, which include pump connections, high-pressure connections for pressure reservoirs, and high-pressure connections for connecting fuel injectors.

8. The high-pressure injection system as defined by claim 2, wherein the pressure booster unit includes a one-piece central body, on which connections are provided, which include pump connections, high-pressure connections for pressure reservoirs, and high-pressure connections for connecting fuel injectors.

9. The high-pressure injection system as defined by claim 1, wherein at injection pressures below a maximum pressure of the high-pressure pump, a required quantity is supplied to the fuel injectors without activation of the pressure booster unit.

10. The high-pressure injection system as defined by claim 1, wherein the pressure booster unit includes at least one on-off valve, which is associated with the at least one pressure booster, and in which the at least one on-off valve is synchronized with injection events in such a way that per cylinder and per 720° of crankshaft angle, one supply stroke of the at least one pressure booster is effected.

11. The high-pressure injection system as defined by claim 1, wherein the pressure booster unit acts upon the high-pressure reservoir which is externally disposed, which in turn subjects the fuel injectors to fuel at high pressure, which fuel injectors communicate with one another via a ring line, or the high-pressure reservoir acts upon the ring line connecting the fuel injectors to one another.

12. The high-pressure injection system as defined by claim 1, wherein the pressure booster unit is acted upon by the high-pressure pump and acts upon the fuel injectors, which communicate hydraulically with one another via a ring line.

13. The high-pressure injection system as defined by claim 1, wherein by means of at least partial overlap of supply stroke courses of the pressure booster pistons, a supply quantity of the pressure booster unit is increased, and a pressure drop in the high-pressure reservoir is reduced.

14. The high-pressure injection system as defined by claim 1, wherein injections are effected synchronously with operation of the pressure booster unit.

15. The high-pressure injection system as defined by claim 1, wherein an injection is effected asynchronously with operation of the pressure booster unit.

16. The high-pressure injection system as defined by claim 13, wherein a high-pressure-boosted replenishing of the pressure booster unit during an injection reduces pressure loss in the high-pressure reservoir from withdrawal of a quantity of fuel.

* * * * *